US007607272B1

(12) United States Patent
Woolworth

(10) Patent No.: US 7,607,272 B1
(45) Date of Patent: Oct. 27, 2009

(54) DRYWALL EXPANSION JOINT

(76) Inventor: Scot Woolworth, 15030 61st St. Northeast, Lake Stevens, WA (US) 98258-8640

( * ) Notice: Subject to any disclaimer, the term of this patent is extended or adjusted under 35 U.S.C. 154(b) by 63 days.

(21) Appl. No.: 11/749,029

(22) Filed: May 15, 2007

(51) Int. Cl.
*E04B 2/00* (2006.01)
*E04B 7/00* (2006.01)
*E04B 2/06* (2006.01)

(52) U.S. Cl. ..... 52/573.1; 52/287.1; 52/393; 52/92.1; 52/93.1; 52/395

(58) Field of Classification Search ..... 52/393, 52/394, 395, 90.1, 92.1, 92.2, 92.3, 93.1, 52/93.2, 698, 715, 396.1, 712–714, 204.66, 52/281, 289, 702, 573.1, 167.1, 287.1, 254
See application file for complete search history.

(56) References Cited

U.S. PATENT DOCUMENTS

| | | | | |
|---|---|---|---|---|
| 2,026,117 | A | 12/1935 | Balduf | |
| 3,126,928 | A | 3/1964 | McMillan | |
| 3,861,104 | A * | 1/1975 | Bower | 52/283 |
| 3,910,001 | A * | 10/1975 | Jackson | 52/281 |
| 4,158,940 | A * | 6/1979 | Lancelot et al. | 52/702 |
| 4,261,155 | A * | 4/1981 | Gilb | 52/702 |
| 4,308,703 | A | 1/1982 | Knowles | |
| 4,490,953 | A | 1/1985 | Meola | |
| 5,555,694 | A * | 9/1996 | Commins | 52/702 |
| 5,651,224 | A | 7/1997 | Brabant | |
| 6,219,975 | B1 | 4/2001 | Olden | |
| 6,711,867 | B1 | 3/2004 | Smith | |
| 6,922,967 | B2 * | 8/2005 | Collie | 52/656.9 |
| 6,931,813 | B2 * | 8/2005 | Collie | 52/713 |
| 7,021,879 | B2 | 4/2006 | Taneichi | |
| 7,104,024 | B1 * | 9/2006 | diGirolamo et al. | 52/710 |

FOREIGN PATENT DOCUMENTS

| | | |
|---|---|---|
| GB | 552283 | 3/1943 |
| GB | 1179267 | 1/1970 |
| GB | 2129905 | 5/1984 |
| GB | 2392177 | 2/2004 |

* cited by examiner

*Primary Examiner*—Brian E. Glessner
*Assistant Examiner*—Jason Holloway
(74) *Attorney, Agent, or Firm*—Michael I Kroll

(57) ABSTRACT

A flanged nailing plate and a drywall nailing plate that work in conjunction with each other to provide an expansion joint. The flanged nailing plate is attached to the wall studs top plate with the interiorly extending flange forming a sill to support one end of the drywall nail flange with the other end nailed to the bottom chord of the truss with the length of the drywall nail flange variable, typically between one to three feet, depending on the installation.

11 Claims, 10 Drawing Sheets

DRYWALL EXPANSION JOINT

BACKGROUND OF THE INVENTION

1. Field of the Invention

The present invention relates generally to building materials and, more specifically, to providing an interior ceiling to wall expansion joint for wall treatment coverings including drywall, sheetrock, gypsum board, plasterboard and sheet paneling.

The present invention is a product designed to minimize sheetrock cracks due to the effects of expansion and contraction of the roof truss system. The cracking created in the sheetrock by truss uplift is unsightly, looks like a structural problem and, as a builder, the number one cause of call backs. The attempted cure is usually temporary and the problem does not go away. Some of the attempted solutions include caulking, spackle and even much more costly crown molding, without success until now. The solution is to provide an expansion joint at the joist wall juncture which will minimize the unsightly cracks while not voiding the truss manufacturer's engineering warrantee.

The present invention provides a flanged nailing plate and a drywall nailing plate that work in conjunction with each other to provide the expansion joint. The flanged nailing plate is attached to the studs top plate with the interiorly extending flange forming a sill to support one end of the drywall nail flange with the other end nailed to the joist with the length of the drywall nail flange variable, typically between one to three feet, depending on the installation.

2. Description of the Prior Art

There are other brackets device designed for construction. Typical of these is U.S. Pat. No. 2,026,117 issued to Balduf on Dec. 31, 1935.

Another patent was issued to McMillan on Mar. 31, 1964 as U.S. Pat. No. 3,126,928. Yet another U.S. Pat. No. 4,308,703 was issued to Knowles on Jan. 5, 1982 and still yet another was issued on Jan. 1, 1985 to Meola as U.S. Pat. No. 4,490,953.

Another patent was issued to Brabant on Jul. 29, 1997 as U.S. Pat. No. 5,651,224. Yet another U.S. Pat. No. 6,219,975 was issued to Olden on Apr. 24, 2001. Another was issued to Smith on Mar. 30, 2004 as U.S. Pat. No. 6,711,867 and still yet another was issued on Apr. 4, 2006 to Taneichi as U.S. Pat. No. 7,021,879.

Another patent was issued to Buelow on Mar. 31, 1943 as U.K. Patent No. GB555,283. Yet another U.K. Patent No. GB1,179,267 was issued to Tracy, et al on Jan. 28, 1970. Another was issued to McTeer on May 23, 1984 as U.K. Patent No. Gb2129905 and still yet another was issued on Feb. 25, 2004 to Baron as U.S. Pat. No. GB2392117.

U.S. Pat. No. 2,026,117

Inventor: Bruno E. Balduf

Issued: Dec. 31, 1935

Resilient building construction comprising a building member, a spring clip having a resilient section, said clip being secured at one end to said member, a recticulated sheet adjacent the opposite end of said clip, a wire securing said sheet to said clip end, and a cementitious layer on said sheet, said resilient section being arranged to yieldingly connect said cementitious layer to said building member.

U.S. Pat. No. 3,126,928

Inventor: Albert L. McMillan

Issued: Mar. 31, 1964

Disclosed is a tool for positioning and holding a pair of members in a predetermined relationship to each other while they are being nailed together, said tool comprising a main body portion, a pair of space support means projecting from the same side of said main body portion, and at least one nail slidably mounted through said main body portion between said support means, said support means being engagable with one of said members to support said main body portion of said tool in spaced relation thereto during driving of said nail into said one member to releasably lock said tool thereto, said other member being engageable with said tool and held thereby in position on said one member.

U.S. Pat. No. 4,308,703

Inventor: James Knowles

Issued: Jan. 5, 1982

A sheet metal web unit for interconnecting vertically spaced apart, horizontal wood chords is formed as an elongated channel-shaped strut with integral, flat, connector plates on its upper and lower ends. The channel is curved and shallower at the lower end of the strut and gradually gets deeper and flatter towards the upper end. The width of the channel gradually decreases and the depth of the channel legs gradually increases from the lower end to the upper end of the strut. A W-shaped web unit is formed of four of such struts integrally connected together by common connector plates. The connector plates overlap vertical face portions of the wood chords and have struck-out teeth for embedding within those overlapped face portions. The ends of the channel leg portions which are closest to the connector plate teeth are extended to overlap and also embed into the adjacent chord face portion to thereby reduce the load on the tooth nearest to the respective strut end. The connector plates are formed with integral, flat, co-planar extension strips which vertically extend into the space between the chords and between the struts which are integral with that plate.

U.S. Pat. No. 4,490,953

Inventor: Michael L. Meola

Issued: Jan. 1, 1985

A metal corner bracket for use in drywall construction in corners on windows and archways to eliminate subsequent cracking at the corners.

U.S. Pat. No. 5,651,224

Inventor: Robert Brabant

Issued: Jul. 29, 1997

An architectural molding assembly is comprised of straight molding pieces having a decorative outer surface and a channel in the rear surface thereof. A wall attaching plate is slidingly secured in the channel and has a slot or an aperture therein to engage with a fastener which is secured to a wall.

The fastener may be in the form of a screw or a clamp having a projecting finger. When the attaching plates are engaged by the fasteners they are urged against the wall and maintained there under tension. No nail is inserted in the molding and molding connecting pieces and accordingly the assembly can be easily dismantled and remounted when desired.

U.S. Pat. No. 6,219,975

Inventor: Michael Marc Olden

Issued: Apr. 24, 2001

A truss, having an integral hold down strap, which can be attached to a wall of a structure. The truss contains an upper and lower chord and typically contains web members that extend between the upper and lower chords to provide strength and rigidity. The lower and upper chord converge at the heel of the truss and are connected by at least one nailing plate. The hold down strap is an elongate piece of sheet metal which is smooth and free of teeth, and has a first portion which contains two opposing flanges that are bent such that the first portion has a generally U-shaped cross section. The hold down strap also has a second portion sized to extend from the first portion and into engagement with one of the other structural components of a wall. The first portion of the hold down strap is sized to engage the end surface of the lower chord with the two opposing flanges engaging the side surfaces of the lower chord. The hold down strap is attached to the lower chord with a nailing plate, typically with the same nailing plate that connects the lower chord to the upper chord member.

U.S. Pat. No. 6,711,867

Inventor: Mark Howard Smith

Issued: Mar. 30, 2004

A construction beam includes a pair of lateral members and a resilient web extending therebetween, so as to present a cross-sectional profile corresponding to commonly used construction beam members (e.g., 2".times.4" or 2".times.6"). The resilience of the web helps to attenuate sound transmission through the beam from one lateral member to the other. In particular, in a wall frame, the lateral members are mounted at opposite ends thereof to end plates consisting of other construction beams according to the present invention (i.e., a pair of lateral members with resilient web extending therebetween).

U.S. Pat. No. 7,021,879

Inventor: Kaoru Taneichi

Issued: Apr. 4, 2006

The anchorage used at a corner part of woods includes a first anchorage including a first anchorage body; nails, punching on a long side plate of the first anchorage body; and nail insertion holes formed at the short side plate of the first anchorage body; and a second anchorage including a second anchorage body, forming via a bended part which overlaps with the short side plate of the first anchorage; nails, punching on a base plate of the second anchorage body; and nails formed in the shape of an overlapped pin, punching on an overlapped part of the second anchorage body so as to insert into the nail insertion holes of the first anchorage. Therefore, it can perform the attachment work easily; it can fix at the corner part by sufficient intensity; and it can attach to the corner part without forming an insertion hole for the bolt.

U.K. Patent Number GB552,283

Inventor: Henry William Buelow

Issued: Mar. 31, 1943

A roof construction comprises main structural members of I, T or channel section metal preferably of the kind described in U.S.A. Specification 1,900,541, which are formed of built-up channel and angle bars to form composite bars having nailing grooves, these composite bars being joined together by channel section' bracket members which can be easily arranged for varying angles of connection. The connecting member comprises a slotted flat web portion 292 provided with flanged edges 294 and tapered extensions 300 extending transversely of the web' and provided with arcuate slots 298. This member is used to connect the upper ends of rafters 112 to a ridge piece 120 by bolts 304, 306, 310, as shown in FIG. 2, and also to connect jack rafters 114, at their upper and lower ends to hip and valley rafters 116 and 118 respectively. In the latter case a sleeve 340 is secured around the main rafters and the ends of the connecting brackets are bent at an angle to the body portion along lines 302, FIG. 3, to lie along one face of the sleeve. The lower ends of the rafters 112 are connected by hinge plates 270 to the inverted channel shaped sill plate 128 supported by the uprights of the framework and the lower ends of the hip and valley rafters are beveled and adapted to be secured to the sill plates by angle brackets 362, FIG. 4. At the gable ends the rafters are attached to sheet metal brackets 320 each having legs 322 adapted to be bent to embrace the flanges of the gable jack studs 108 and with an inclined portion 326 adapted to be screwed to the rafter 112, the stud 108 and rafter 112 being expanded at the bracket by means of nails driven through the bracket and into the members as described in Specification 552,284.

U.K. Patent Number GB 1,179,267

Inventor: Charles W. Tracy, et al.

Issued: Jan. 28, 1970

A bracket for connecting together the beams of a roof frame includes overlapping angularly adjustable portions 26, 28 having alignable apertures 29, 32 through which nails are passed. The bracket 19, shown in FIG. 6, has two pairs of adjustable portions 26, 28 and is used for connecting two rafters 18 to a ridge beam 14, 15. The central portion 20 overlies the ridge beam and is nailed thereto. Tabs 33, 34 may be provided and are nailed to the underside of the ridge beam. A bracket 43 with only one pair of adjustable portions (50, 54) (FIGS. 8, 15) is used to connect a single rafter to a ridge beam. A bracket 58 with two pairs of adjustable portions (65, 68 FIGS. 9, 17) disposed at an angle to the central portion (59) is used to connect a pair of hips 16 to an end of a ridge beam. A bracket with only one pair of adjustable portions (79, 85, FIGS. 12, 18) disposed at an angle to the central portion (73) is used to connect a single hip to a ridge beam. A bracket 87 with two pairs of adjustable portions (103, 108, FIGS. 10, 11, 20, 21) disposed at an angle to the central portion (89) and connected thereto by a portion (96) of the central portion engaging a slot (100) in each pair of adjustable portions is used to connect a pair of jack rafters 88 to a hip 16. The adjustable portions (103, 108) are set by bending two members (109) on the portion (108) into notches (106) in the portion (103). The bendable members (109) and the notches (106) may be staggered so that only one bendable member is in alignment with a notch. In a modification (FIG. 19) the central portion (111) is integral with the adjustable portions (117, 122). A bracket 125, similar to the modification of (FIG. 19) but with the adjustable portions (132, 137, FIGS. 13, 22) at an upward angle instead of a downward angle to the central portion (126) is used to connect a valley 17 to a pair of jack rafters 88. A bracket for connecting a single rafter to a valley is similar to the bracket 125 but has only one pair of adjustable portions (148, 152, FIG. 23).

U.K. Patent Number GB 2 129 905

Inventor: Joseph Robinson McTeer

Issued: May 23, 1984

Each bracket 1, 2 of a set for connecting frame members at corners of a frame 15 comprises a planar body with two convergent sides from which side flanges project, so that the body can lie on co-planar surfaces of the frame members and the side flanges can embrace side surfaces of the members at the corner. There are holes in the brackets for fixing them by e.g. screws or nails to the frame members. For coupling to a similar bracket of another frame, at least one bracket has coupling means, which may comprise a tie plate 17, 24 with holes, slots, or a hole and one or more slots for engagement with e.g. screws or nails at the brackets. One or more of the brackets may have a spike 9 for driving into the ground. Frames constructed with the brackets may be included in modules 14, 21 for fruit cages, staging, fencing or other structures of various kinds.

U.K. Patent Number GB 2 392 177

Inventor: Paul Baron

Issued: Feb. 2, 2004

A support I for a joist 7 comprises a first plate 2 with a first bracket (3, FIG. 1) and a separate second plate with a second bracket; the plates being secured to respective sides of the joist and the brackets projecting from the end of the joist to be supported by a structure such as a wall 8. The respective plates and brackets may be integrally formed from a single sheet of metal or the plates may be first attached to the joist and later to the brackets. The plates may have tangs (4, FIG. 1) or be secured to the joist by nails. Each bracket may have a flange (6, FIG. 1) perpendicular to the plate to secure to the upper surface of the structure. In another aspect, there is a method of supporting the end of a joist from a structure such as masonry, brick or timber wall using first and second plates secured to the opposed edges of the joist but which leaves the underside of the joist unencumbered to present a flush surface.

While these brackets may be suitable for the purposes for which they were designed, they would not be as suitable for the purposes of the present invention, as hereinafter described.

SUMMARY OF THE PRESENT INVENTION

A primary object of the present invention is to provide an expansion joint between interior walls and ceiling.

Another object of the present invention is to provide a device comprising a flanged nail plate and a drywall nailing plate.

Yet another object of the present invention is to support one end of the drywall nailing plate atop the flanged nail plate while the other is secured to the bottom chord of the roof truss.

Additional objects of the present invention will appear as the description proceeds.

The present invention overcomes the shortcomings of the prior art by providing a flanged nailing plate and a drywall nailing plate that work in conjunction with each other to provide an expansion joint. The flanged nailing plate is attached to the interior wall top plate with the interiorly extending flange forming a sill to support one end of the drywall nail flange with the other end nailed to the bottom chord of the roof truss with the length of the drywall nail flange variable, typically between one to three feet, depending on the installation.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
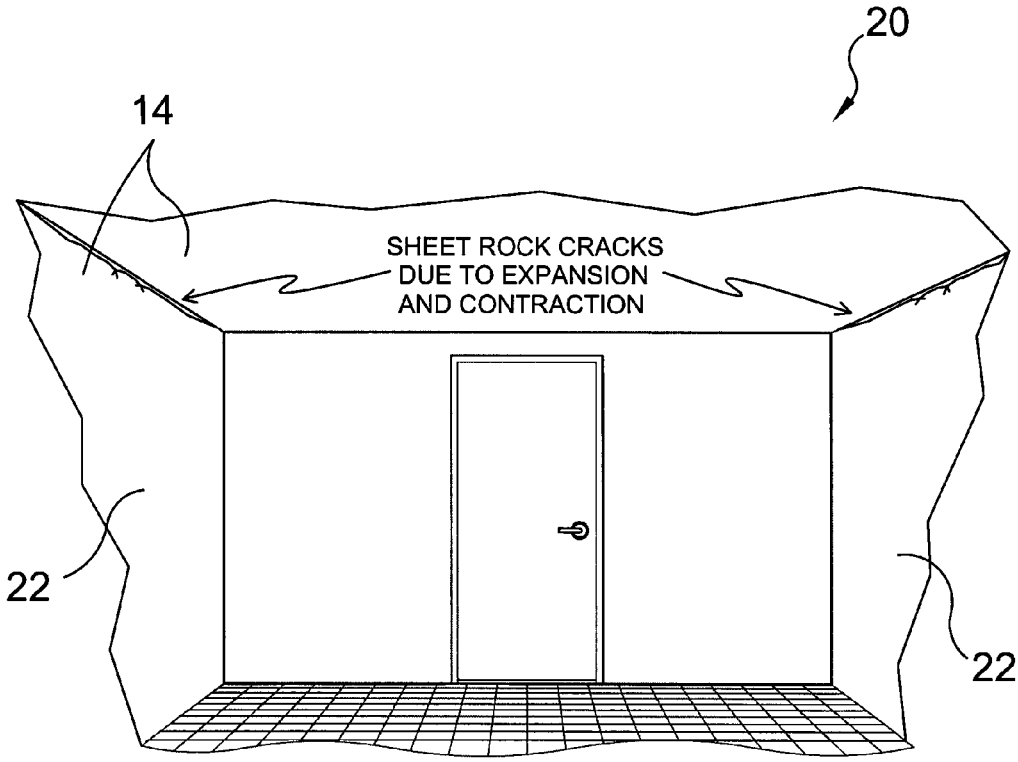
(PRIOR ART) FIG. 1
FIG. 1 is an illustrative view of prior art.

FIG. 1 is an illustrative view of prior art 20. Sheet rock 14 cracks due to the effects of expansion and contraction of the roof truss system because there is no flex point between the truss and the interior walls 22. The present invention overcomes this problem by providing a flex point between the joist and interior walls.

Figure 2:
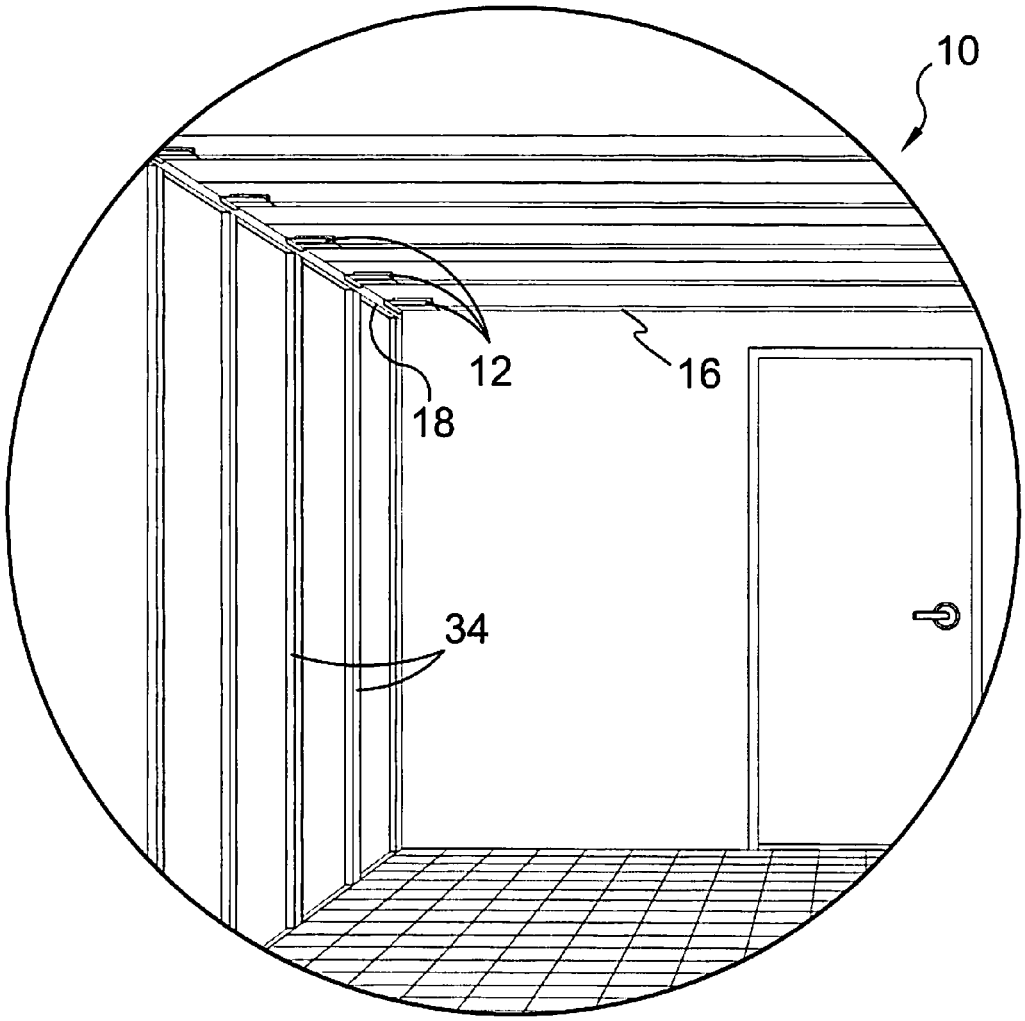
FIG. 2 is an illustrative view of the present invention in use.

FIG. 2 is an illustrative view of the present invention 10 in use. The present invention is an expansion joint 12 designed to minimize sheetrock cracks due to the effects of expansion and contraction of the roof truss system 16. It is designed to provide a flex point between the truss 16 and the interior walls. The device will not hinder the truss 16 movement but will allow the sheet rock to stay relatively stationary to reduce the uplifting pressure. One end of the expansion joint 12 is secured to a wall stud 34 top plate 18 and the other end is fastened to the bottom chord of the truss 16.

Figure 3:
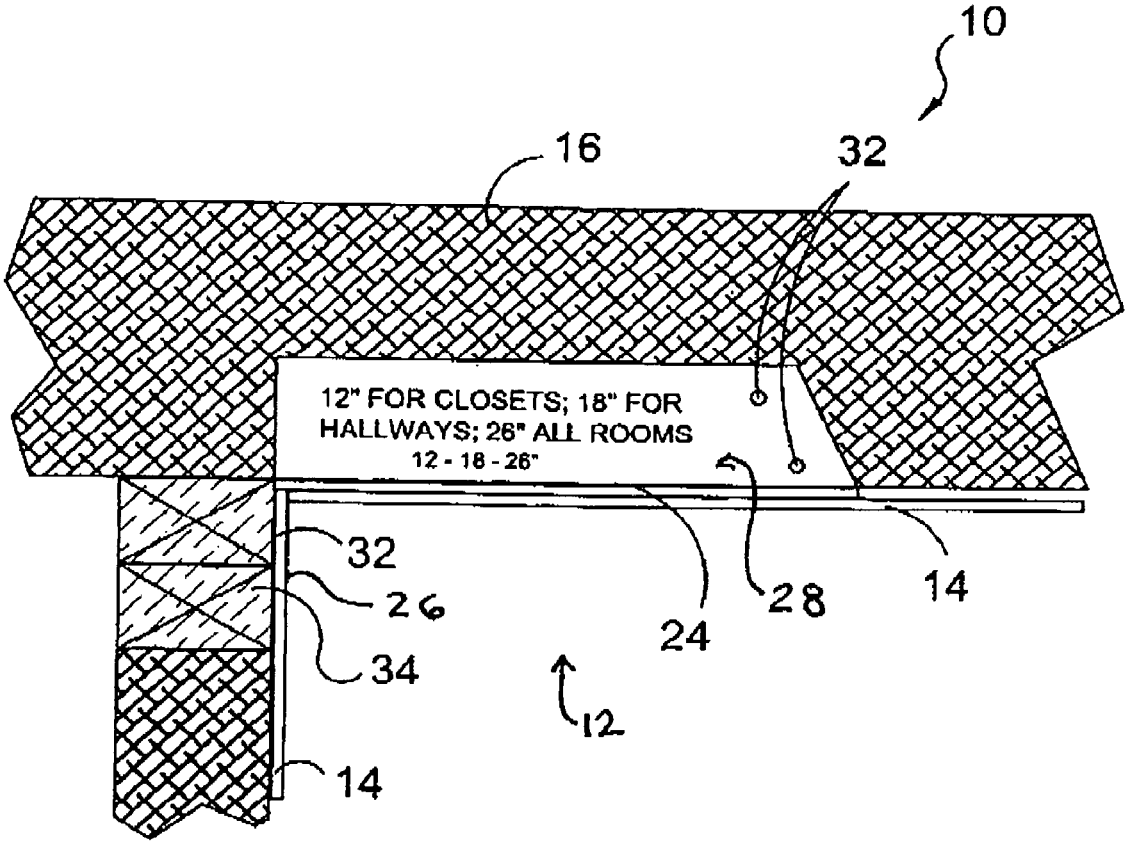
FIG. 3 is an illustrative view of the present invention in use.

FIG. 3 is an illustrative view of the present invention 10 in use. Shown is the expansion joint 12 of the present invention 10 comprising a flanged nail plate 26 attached to the wall top plate 18 (see FIG. 2) forming support for a pair of drywall nail plates 24 extending longitudinally therefrom that are connected while the other end is attached to the truss 16 with fastener elements 32 such as nails or screws passing through a truss plate 28 projecting centrally from the top portion thereof. The flange supported end of the drywall nailing plate 24 will remain in place due to the attached drywall 14 and weight of the insulation.

Figure 4:
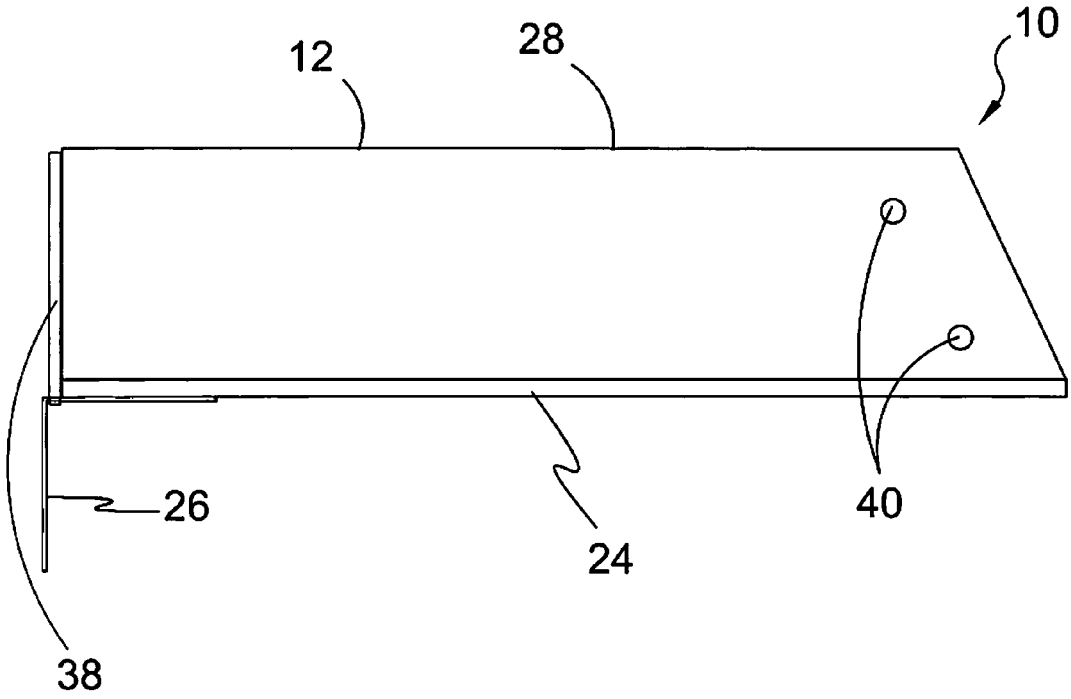
FIG. 4 is a side view of the present invention.

FIG. 4 is a side view of the present invention 10. The drywall joint flexure is created by installing the expansion joint 12 on every truss to wall top plate juncture or as desired, drywall will be secured to one drywall nailing plate 24 not to the truss so that during expansion and contraction of the building structure the drywall nailing plates 24 will flex and the device itself attached at only one end should also allow for flexure. The truss plate 28 is only secured to the truss at the end opposing the flanged wall nail plate 26 and has offset fastener apertures 40. A pivot pin 38 is spot welded to attach the wall nail plate flange 26 to the drywall flange and allows for pivoting.

Figure 5:
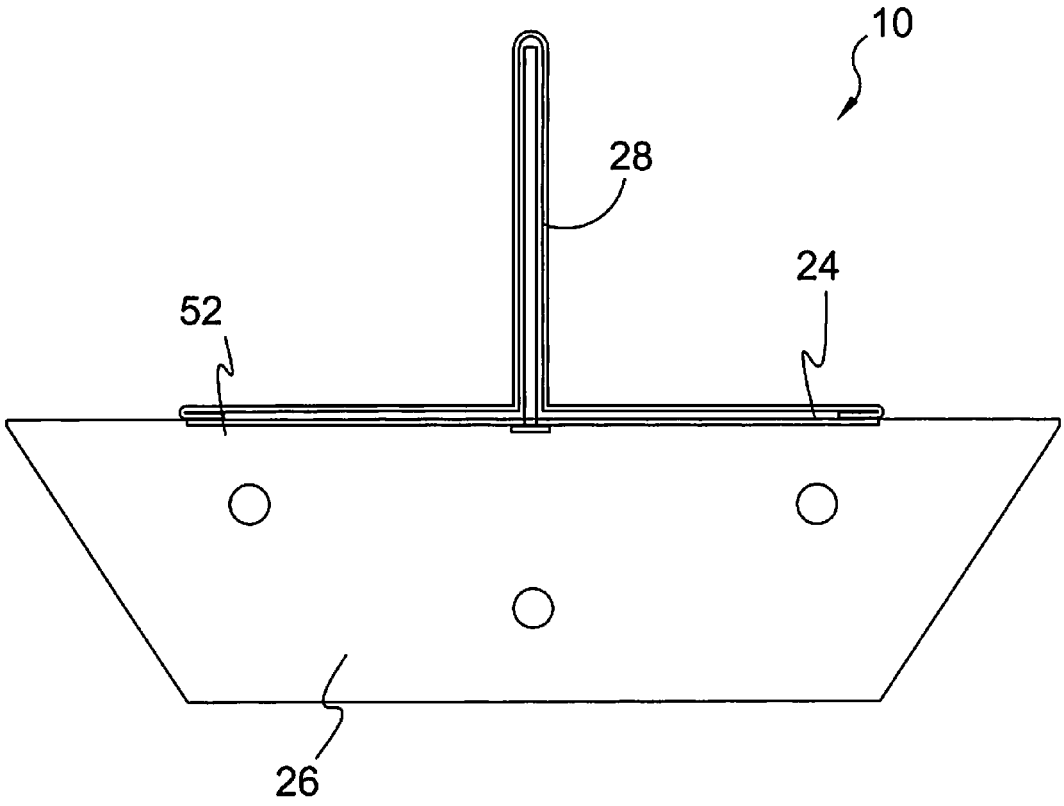
FIG. 5 is an end view of the present invention assembled.

FIG. 5 is an end view of the present invention 10 assembled. The drywall joint flexure is created by installing the expansion joint 12 on every truss to wall juncture or as desired, drywall will be secured to the flange(s) (not to the truss) so that during expansion and contraction of the building structure the drywall flanges will flex.

Figure 6:
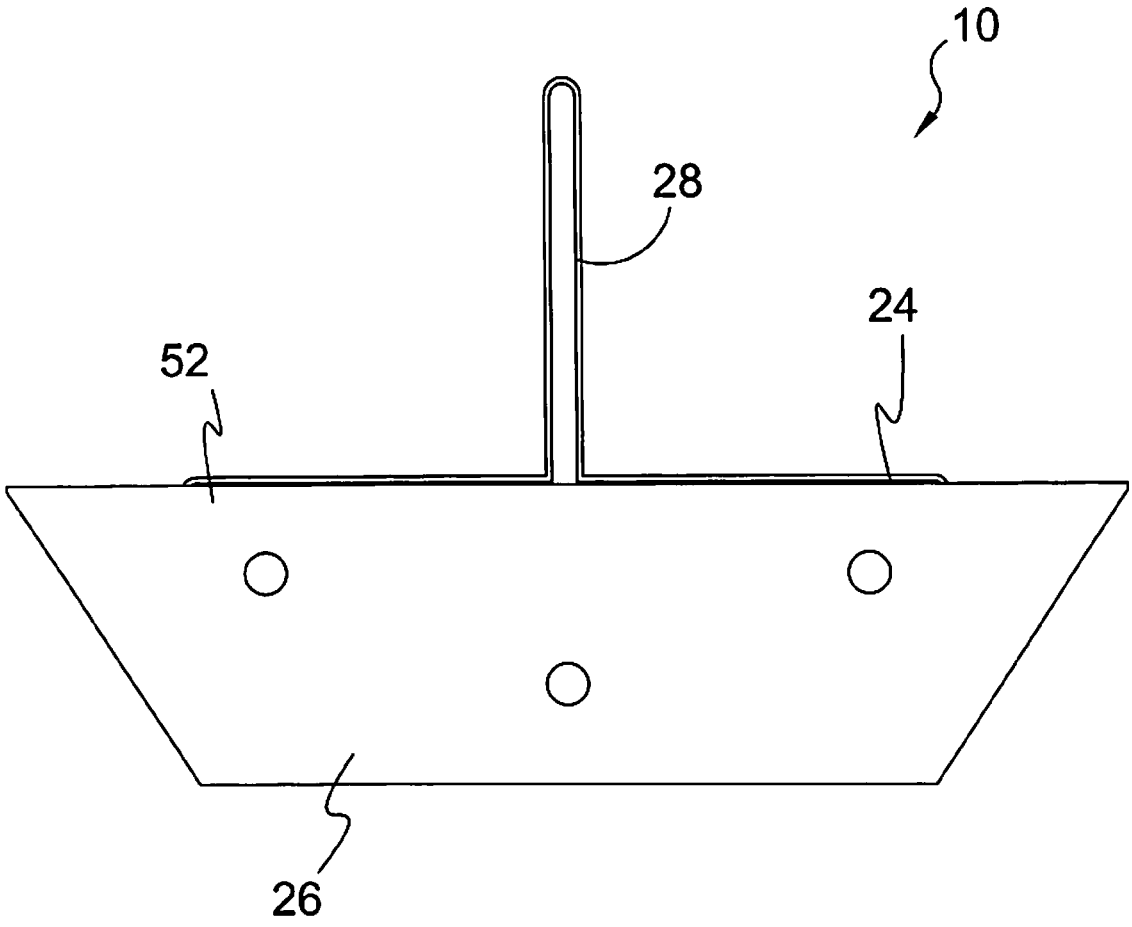
FIG. 6 is an opposite end view of the present invention assembled.

FIG. 6 is an opposite end view of the present invention 10 assembled. The drywall joint flexure is created by installing the present invention 10 on every joist to a wall juncture or as desired, drywall will be secured to the flange(s) (not to the truss) so that during expansion and contraction of the building structure the drywall flanges will flex.

Figure 7:
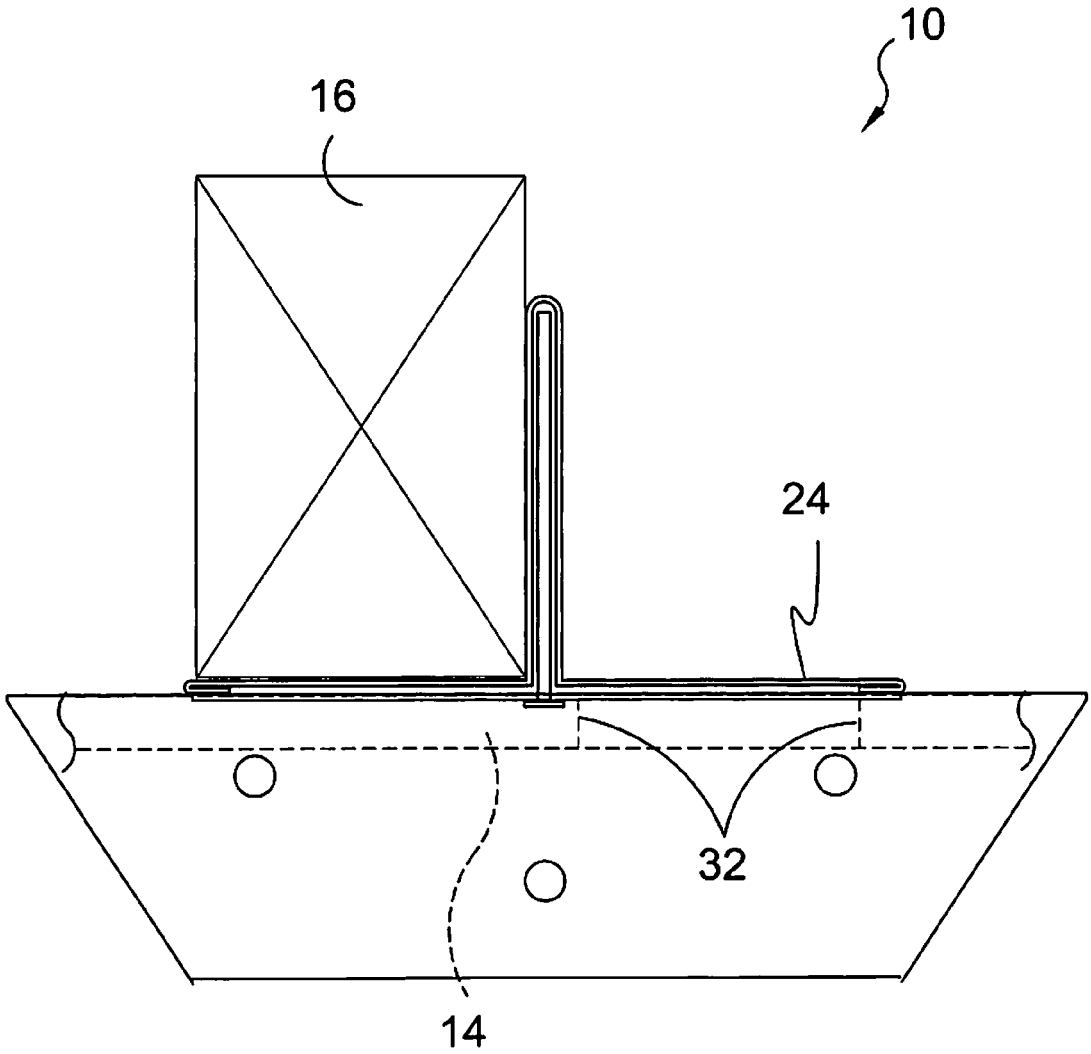
FIG. 7 is an end view with attached sheetrock.

FIG. 7 is an end view with attached sheetrock 14. The drywall joint flexure is created by installing the present invention 10 on every truss to wall juncture or as desired, drywall will be secured to the flange(s) 24 (not to the truss) so that during expansion and contraction of the building structure the drywall flanges 24 will flex much like the wings of an airplane and the device itself attached at only one end will allow for flexure.

Figure 8:
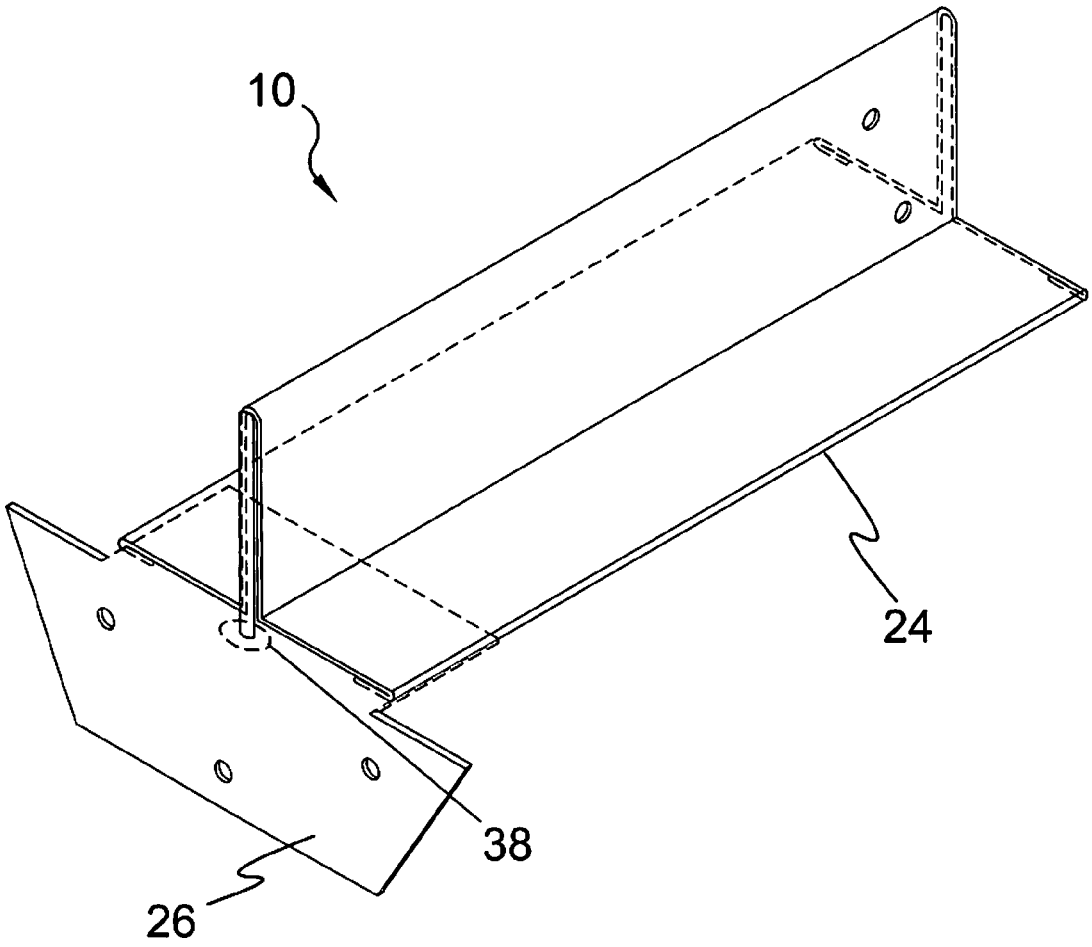
FIG. 8 is a perspective view of the present invention.

FIG. 8 is a perspective view of the present invention 10. The drywall joint flexure is created by installing one of these devices on every truss to wall juncture or as desired, drywall will be secured to the flange(s) 24 (not to the truss) so that during expansion and contraction of the building structure the drywall flanges 24 will flex much like the wings of an airplane and the device itself is attached only on each end which should also allow for flexure. The pivot pin 38 will attach the wall flange 24 to the body of the device and will allow wall flange 24 to pivot. This will allow for the invention to be used even when walls are not perpendicular (90 degrees) to roof truss. The flange 24 will also bend to allow for sloped ceilings as needed.

Figure 9:
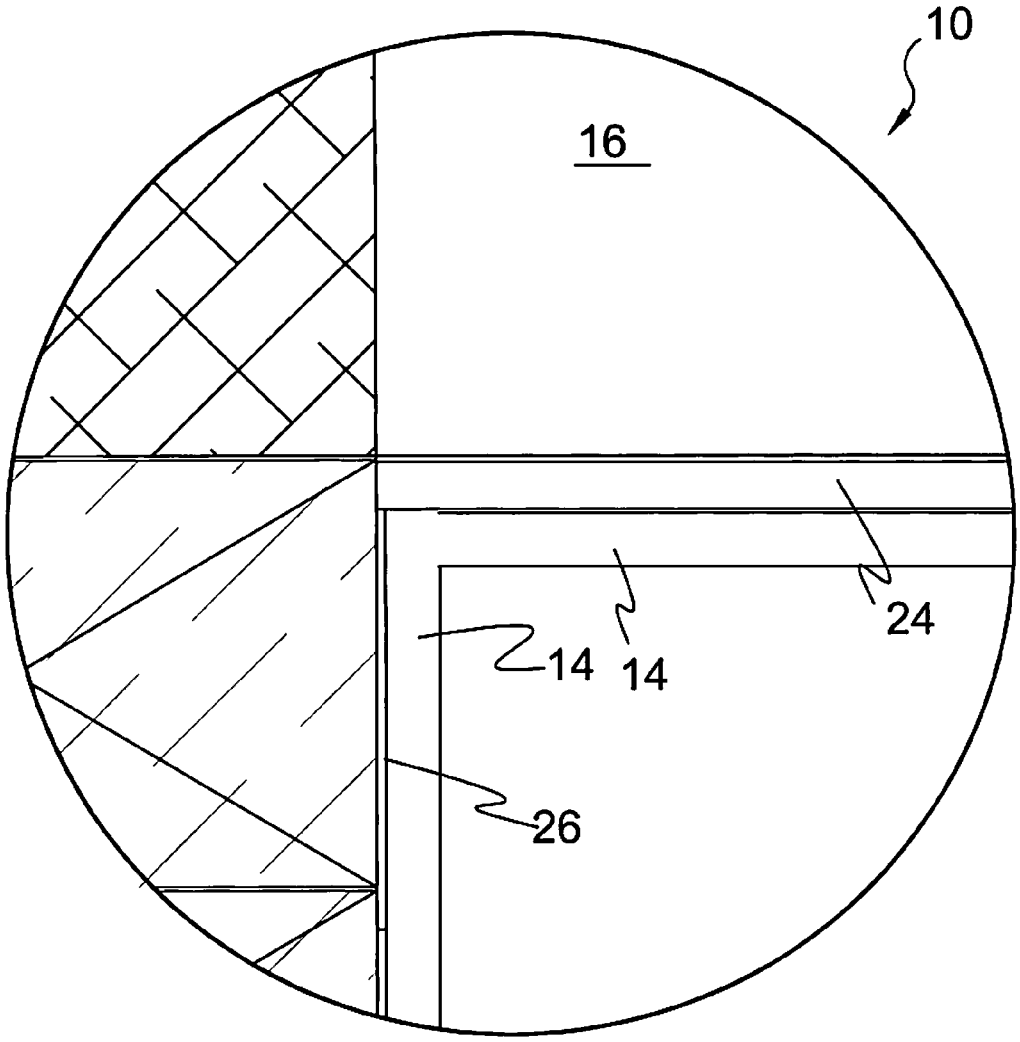
FIG. 9 is an illustrative view of the present invention in use.

FIG. 9 is an illustrative view of the present invention 10 in use. The drywall joint flexure is created by installing one of these devices on every truss to wall juncture or as desired, drywall will be secured to the flange(s) 24 (not to the truss) so that during expansion and contraction of the building structure the drywall flanges 24 will flex much like the wings of an airplane and the device itself is attached only on each end which should also allow for flexure. The pivot pin 38 (see FIG. 8) will attach the wall flange 24 to the body of the device and will allow wall flange 24 to pivot. This will allow for the invention to be used even when walls are not perpendicular (90 degrees) to roof truss. The flange 24 will also bend to allow for sloped ceilings as needed.

Figure 10:
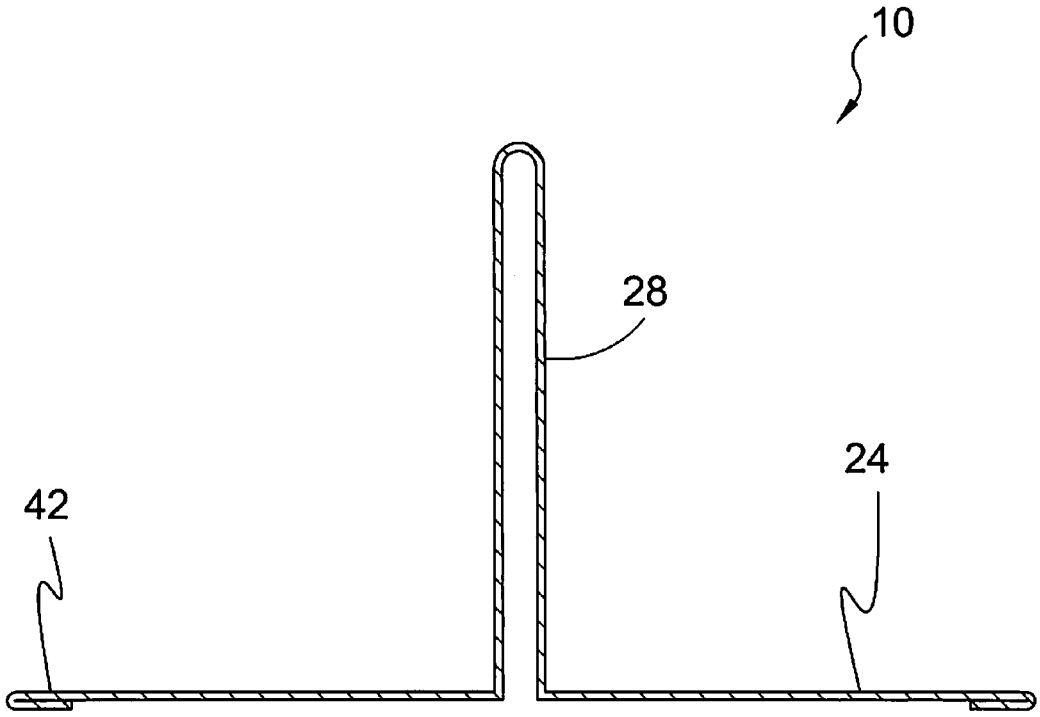
FIG. 10 is a sectional view of the drywall nailing plate.

FIG. 10 is a sectional view of the drywall flanges 24 of the present invention 10. The drywall joint flexure is created by installing one of these devices on every truss to wall juncture or as desired, drywall will be secured to the flange(s) 24 (not to the truss) so that during expansion and contraction of the building structure the drywall flanges 24 will flex much like the wings of an airplane and the device itself is attached only on each end which should also allow for flexure. The present invention 10 is an anti-crack device designed to minimize sheet rock cracks due to the effects of expansion and contraction of the roof truss system. It is designed to provide a flex point between the truss and the interior walls. The device will not hinder the truss movement but will allow the sheet rock to stay relatively stationary to reduce the uplifting pressure.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An expansion joint for joining ceiling dry wall to wall dry wall to prevent structural damage from separation and cracking due to expansion and contraction of roof trusses comprising;

a) a pair of longitudinally parallel dry wall flanges;

b) a truss plate communicating between said dry wall flanges;

c) a fanged wall nail plate projecting from one side of said dry wall flanges;

d) said truss plate having an inverted U-shape with distal ends of legs thereof integral with each of said dry wall flanges, respectively, said truss plate being perpendicular to said dry wall flanges on a side of said dry wall flanges opposite to that of said flanged wall nail plate; and e) a pivot pin joining said flanged wall plate to said truss plate to allow pivoting of said truss plate with respect to said flanged wall nail plate.

2. The expansion joint recited in claim 1, wherein said flanged wall nail plate comprises a plurality of fastener recesses for accommodating screws and nails to pass therethrough.

3. The expansion joint recited in claim 2, wherein said truss plate includes a plurality of recesses for accommodating screws and nails to pass therethrough.

4. The expansion joint recited in claim 3, wherein said fastener recesses of said truss plate are disposed on the end opposing said flanged wall nail plate.

5. The expansion joint recited in claim 4, wherein said fastener recesses of said truss plate are offset.

6. The expansion joint recited in claim 5, wherein said truss plate is secured to a bottom chord of a roof truss using fastening elements extending through said recesses.

7. The expansion joint recited in claim 6, wherein said truss plate is in longitudinal communication with interior edges of said drywall flanges.

8. The expansion joint recited in claim 4, wherein said flanged wall nail plate is secured to the top plate of the wall frame by inserting fastening elements taken from a group including screws and nails and inserting through said recesses.

9. The expansion joint recited in claim 8, wherein said expansion joint is fabricated of a resilient material.

10. The expansion joint recited in claim 9, wherein said resilient material is metallic.

11. In combination, a roof truss, interior walls, and an expansion joint to prevent structural damage from separation and cracking due to expansion and contraction of the roof truss comprising;

a) said expansion joint comprising a flanged wall nail plate with a flange thereof secured to an interior wall stud top plate and a body of said wall nail plate in contact with a pair of longitudinally parallel dry wall flanges, a truss plate extending perpendicularly from an opposite side of said dry wall flanges, said roof truss fastened to one of said dry wall flanges on said opposite side of said dry wall flange adjacent to said truss plate;

b) said truss plate having an inverted U-shape with distal ends of lees thereof integral with each of said dry wall flanges, respectively; and c) said wall nail plate flange having mounted thereon a pivot pin welded at one end to said wall nail plate flange, said pivot pin extending along and edge of said truss to which said truss plate is attached to allow relative movement of said roof truss with respect to said wall stud top plate.

* * * * *